US011139583B2

(12) United States Patent
Hu et al.

(10) Patent No.: US 11,139,583 B2
(45) Date of Patent: Oct. 5, 2021

(54) DIELECTRIC LENS AND MULTI-BEAM ANTENNA

(71) Applicant: Huawei Technologies Co., Ltd., Shenzhen (CN)

(72) Inventors: Banghong Hu, Shenzhen (CN); Liangyuan Li, Shenzhen (CN); Zuoxing Dai, Shanghai (CN); Lei Li, Shanghai (CN); Yuanhong Zhang, Shenzhen (CN); Runxiao Zhang, Shenzhen (CN); Yaojiang Zhang, Shenzhen (CN)

(73) Assignee: HUAWEI TECHNOLOGIES CO., LTD., Shenzhen (CN)

( * ) Notice: Subject to any disclaimer, the term of this patent is extended or adjusted under 35 U.S.C. 154(b) by 202 days.

(21) Appl. No.: 16/245,676

(22) Filed: Jan. 11, 2019

(65) Prior Publication Data

US 2019/0148836 A1 May 16, 2019

Related U.S. Application Data

(63) Continuation of application No. PCT/CN2017/075958, filed on Mar. 8, 2017.

(30) Foreign Application Priority Data

Jul. 14, 2016 (CN) ..... 201610555043.5

(51) Int. Cl.
*H01Q 15/24* (2006.01)
*H01Q 15/16* (2006.01)
(Continued)

(52) U.S. Cl.
CPC ..... *H01Q 15/16* (2013.01); *H01Q 1/246* (2013.01); *H01Q 1/42* (2013.01); *H01Q 15/08* (2013.01);
(Continued)

(58) Field of Classification Search
CPC ..... H01Q 15/16; H01Q 19/062; H01Q 1/246; H01Q 1/42; H01Q 15/08; H01Q 21/20
See application file for complete search history.

(56) References Cited

U.S. PATENT DOCUMENTS 5,047,776 A 9/1991 Baller
6,590,544 B1 7/2003 Filipovic
(Continued)

FOREIGN PATENT DOCUMENTS

CN 1073303 A 6/1993
CN 101662076 A 3/2010
(Continued)

OTHER PUBLICATIONS

Foreign Communication From A Counterpart Application, Chinese Application No. 201610555043.5, Chinese Office Action dated Apr. 28, 2019, 3 pages.
(Continued)

*Primary Examiner* — Dieu Hien T Duong
(74) *Attorney, Agent, or Firm* — Conley Rose, P.C.

(57) ABSTRACT

A dielectric lens, where the dielectric lens is a cylindrical lens or an ellipsoidal lens whose cross-sectional profile is a quasi-ellipse, and the dielectric lens is formed by piling a plurality of units. Dielectric constant distribution of the units in the dielectric lens enables a non-plane wave in a minor axis direction of the quasi-ellipse to be converted into a plane wave through the dielectric lens. The units of the dielectric lens are prepared through extrusion, injection, molding, computer numerical control (CNC) machining, or a three dimensional (3D) printing process technology, and the units may be assembled through gluing, welding, structural clamping, or a coupling printed through 3D printing. When the dielectric lens is applied to a multi-beam antenna, a system capacity of a communications system can be
(Continued)

increased. In addition, a thickness of the lens is reduced using the multi-beam antenna.

29 Claims, 7 Drawing Sheets

(51) Int. Cl.

| | |
|---|---|
| ***H01Q 19/06*** | (2006.01) |
| ***H01Q 1/24*** | (2006.01) |
| ***H01Q 1/42*** | (2006.01) |
| ***H01Q 15/08*** | (2006.01) |
| ***H01Q 21/20*** | (2006.01) |
| *H01Q 19/10* | (2006.01) |
| *H01Q 21/06* | (2006.01) |

(52) U.S. Cl.
CPC ..... *H01Q 19/062* (2013.01); *H01Q 21/20* (2013.01); *H01Q 19/108* (2013.01); *H01Q 21/062* (2013.01)

(56) References Cited

U.S. PATENT DOCUMENTS

| | | | | |
|---|---|---|---|---|
| 8,518,537 | B2 | 8/2013 | Matitsine | |
| 2008/0278394 | A1 | 11/2008 | Koh et al. | |
| 2010/0134368 | A1* | 6/2010 | Lafond | H01Q 19/06 343/754 |
| 2010/0321262 | A1 | 12/2010 | Pohl | |
| 2014/0227966 | A1 | 8/2014 | Artemenko et al. | |
| 2015/0091767 | A1* | 4/2015 | Matitsine | H01Q 21/062 343/755 |
| 2017/0229786 | A1 | 8/2017 | Zou et al. | |
| 2018/0097290 | A1 | 4/2018 | Matitsine et al. | |
| 2018/0294577 | A1 | 10/2018 | Shi et al. | |

FOREIGN PATENT DOCUMENTS

| | | | |
|---|---|---|---|
| CN | 101971423 | A | 2/2011 |
| CN | 102176538 | A | 9/2011 |
| CN | 102610926 | A | 7/2012 |
| CN | 105390824 | A | 3/2016 |
| CN | 105659434 | A | 6/2016 |
| EP | 2523256 | A1 | 11/2012 |
| WO | 2016061825 | A1 | 4/2016 |
| WO | 2017127378 | A1 | 7/2017 |

OTHER PUBLICATIONS

Foreign Communication From A Counterpart Application, Chinese Application No. 201610555043.5, Chinese Search Report dated Apr. 18, 2019, 2 pages.

Machine Translation and Abstract of Chinese Publication No. CN101662076, Mar. 3, 2010, 7 pages.

Machine Translation and Abstract of Chinese Publication No. CN102176538, Sep. 7, 2011, 11 pages.

Machine Translation and Abstract of Chinese Publication No. CN102610926, Jul. 25, 2012, 13 pages.

Foreign Communication From A Counterpart Application, PCT Application No. PCT/CN2017/075958, English Translation of International Search Report dated May 27, 2017, 3 pages.

Foreign Communication From A Counterpart Application, PCT Application No. PCT/CN2017/075958, English Translation of Written Opinion dated May 27, 2017, 5 pages.

Machine Translation and Abstract of Chinese Publication No. CN1073303, Jun. 16, 1993, 12 pages.

Foreign Communication From A Counterpart Application, Chinese Application No. 201610555043.5, Chinese Office Action dated Nov. 5, 2019, 8 pages.

Foreign Communication From A Counterpart Application, Chinese Application No. 201610555043.5, Chinese Search Report dated Oct. 28, 2019, 2 pages.

Komljenovic, T., et al., "Multilayer Hemi-Spheroidal Lenses for Vehicle-Mounted Scanning Antennas," XP31470420, 3rd European Conference on Antennas and Propagation, Mar. 2009, pp. 3042-3046.

Grzesik, J.A., "Focusing Properties of a Three-parameter Class of Oblate, Luneburg-like Inhomogeneous Lenses," XP55591508, Journal of Electromagnetic Waves and Applications, vol. 19, Issue 8, 2005, pp. 1005-1019.

Foreign Communication From A Counterpart Application, European Application No. 17826782.9, Extended European Search Report dated Jun. 5, 2019, 11 pages.

* cited by examiner

DIELECTRIC LENS AND MULTI-BEAM ANTENNA

CROSS-REFERENCE TO RELATED APPLICATIONS

This application is a continuation of International Patent Application No. PCT/CN2017/075958 filed on Mar. 8, 2017, which claims priority to Chinese Patent Application No. 201610555043.5 filed on Jul. 14, 2016. The disclosures of the aforementioned applications are hereby incorporated by reference in their entireties.

TECHNICAL FIELD

Embodiments of this application relate to the communications field, and in particular, to a dielectric lens and a multi-beam antenna.

BACKGROUND

A conventional antenna used in the communications industry is shown in FIG. 1, and generally includes three main parts, (1) a radome, (2) a feeding network, a reflection panel, and a dipole array, and (3) an enclosure frame and a module (active). With substantial increase of users, a current network is faced with a problem of system capacity shortage.

A multi-beam antenna technology is intended to increase a system capacity of a mobile communications system and improve communication quality of the system, and is a technical solution having a desired application prospect. A feasible solution is to dispose an electromagnetic lens in a multi-beam antenna to increase a system capacity, but how to design the electromagnetic lens becomes a technical bottleneck.

SUMMARY

Embodiments of this application provide a dielectric lens that can be applied to a multi-beam antenna in order to increase a system capacity of a communications system.

According to a first aspect, a dielectric lens is provided. The dielectric lens is a cylindrical lens, a cross-sectional profile of the cylindrical lens is a quasi-ellipse, the cylindrical lens is formed by piling a plurality of units, and dielectric constant distribution of the plurality of cylindrical units in the dielectric lens enables a non-plane wave in a minor axis direction of the quasi-ellipse to be converted into a plane wave after passing through the lens. A length of each cylindrical unit is equal to a length of the cylindrical lens.

In this way, the cross section of the dielectric lens in this embodiment of this application is the quasi-ellipse such that the non-plane wave in the minor axis direction of the quasi-ellipse is converted into the plane wave through the dielectric lens. In this way, when the dielectric lens used as an electromagnetic lens is applied to a multi-beam antenna, a system capacity of a communications system can be increased. In addition, in this embodiment of this application, a major axis direction of the quasi-ellipse is in a width direction of the antenna, and a minor axis direction of the quasi-ellipse is in a thickness direction of the antenna. Because a minor axis of the quasi-ellipse is less than a major axis, when the dielectric lens is applied to the multi-beam antenna, an increased size in the thickness direction of the multi-beam antenna can meet a size requirement of the multi-beam antenna.

Further, when a Luneberg lens is applied to the multi-beam antenna, increased sizes in the thickness direction and the width direction of the antenna are basically consistent. However, using the dielectric lens in this embodiment of this application, because the minor axis of the quasi-ellipse is less than the major axis, a thickness of the antenna can be greatly reduced while ensuring antenna performance. Compared with the Luneberg lens, the dielectric lens in this embodiment of this application can be used to greatly reduce the thickness of the antenna.

Optionally, the dielectric constant distribution is obtained through numerical fitting based on Fermat's principle and Snell's law.

With reference to the first aspect, in a first possible implementation of the first aspect, the length of the dielectric lens is denoted as L, and 100 millimeters (mm)≤L≤3500 mm.

With reference to the first aspect or the first possible implementation of the first aspect, in a second possible implementation of the first aspect, a major axis of the quasi-ellipse serving as the cross section of the dielectric lens is denoted as Da, a minor axis of the quasi-ellipse serving as the cross section of the dielectric lens is denoted as Db, and 1 mm≤Db<Da≤450 mm.

With reference to any one of the first aspect, or the foregoing possible implementations of the first aspect, in a third possible implementation of the first aspect, a connection between the plurality of cylindrical units is any one of welding, gluing, structural clamping, and a connection printed using a three dimensional (3D) printing technology. A process of preparing the plurality of cylindrical units is any one of extrusion, injection, molding, computer numerical control (CNC) machining, and a 3D printing process technology.

With reference to any one of the first aspect, or the foregoing possible implementations of the first aspect, in a fourth possible implementation of the first aspect, each unit is a solid unit.

With reference to the fourth possible implementation of the first aspect, in a fifth possible implementation of the first aspect, a cross section of the unit is a first polygon.

Optionally, the first polygon may be a regular polygon.

Optionally, the first polygon is an inscribed polygon of a first circle, a diameter of the first circle is denoted as D1, and 1 mm≤D1≤450 mm.

Optionally, the first polygon is an inscribed polygon of a first ellipse, a major axis of the first ellipse is denoted as D1a, a minor axis of the first ellipse is denoted as D1b, and 1 mm≤D1b<D1a≤450 mm.

With reference to the fourth possible implementation of the first aspect, in a sixth possible implementation of the first aspect, a cross section of the unit is a fourth circle or a fourth ellipse, a diameter of the fourth circle is denoted as D4, a major axis of the fourth ellipse is denoted as D4a, and a minor axis of the fourth ellipse is denoted as D4b, where 1 mm≤D4≤450 mm, and 1 mm≤D4b<D4a≤450 mm.

With reference to any one of the first aspect, or the first to the third possible implementations of the first aspect, in a seventh possible implementation of the first aspect, each unit is a hollow unit.

With reference to the seventh possible implementation of the first aspect, in an eighth possible implementation of the first aspect, an outer profile of a cross section of the unit is a second polygon, and an inner profile is a third polygon.

Optionally, a quantity of sides of the second polygon and a quantity of sides of the third polygon are equal or unequal.

Optionally, the second polygon is a regular polygon, and/or the third polygon is a regular polygon.

Optionally, the second polygon is an inscribed polygon of a second circle, the third polygon is an inscribed polygon of a third circle, a diameter of the second circle is denoted as D2, a diameter of the third circle is denoted as D3, and 1 mm≤D3<D2≤450 mm.

Optionally, the second polygon is an inscribed polygon of a second ellipse, the third polygon is an inscribed polygon of a third ellipse, a major axis of the second ellipse is denoted as D2a, a minor axis of the second ellipse is denoted as D2b, a major axis of the third ellipse is denoted as D3a, and a minor axis of the third ellipse is denoted as D3b, where 1 mm<D3a<D2a≤450 mm, 1 mm≤D3b<D2b<450 mm, D2a>D2b, and D3a>D3b.

With reference to the seventh possible implementation of the first aspect, in a ninth possible implementation of the first aspect, an outer profile of a cross section of the unit is a fifth ellipse, an inner profile is a sixth ellipse, a major axis of the fifth ellipse is denoted as D5a, a minor axis of the fifth ellipse is denoted as D5b, a major axis of the sixth ellipse is denoted as D6a, and a minor axis of the sixth ellipse is denoted as D6b, where 1 mm<D6a<D5a≤450 mm, 1 mm≤D6b<D5b<450 mm, D5a>D5b, and D6a>D6b.

According to a second aspect, a dielectric lens is provided. The dielectric lens is a quasi-ellipsoidal lens, a maximum cross section of the quasi-ellipsoidal lens is a quasi-ellipse, the quasi-ellipsoidal lens is formed by tightly piling a plurality of units, and dielectric constant distribution of the plurality of units in the dielectric lens enables a non-plane wave in a minor axis direction of the quasi-ellipse to be converted into a plane wave after passing through the lens. Each unit is a solid unit or a hollow unit.

In this way, the dielectric lens in this embodiment of this application is the quasi-ellipsoidal lens, and the maximum cross section is the quasi-ellipse such that the non-plane wave in the minor axis direction of the quasi-ellipse is converted into the plane wave through the dielectric lens. In this way, when the dielectric lens used as an electromagnetic lens is applied to a multi-beam antenna, a system capacity of a communications system can be increased. In addition, in this embodiment of this application, a major axis direction of the quasi-ellipse is used as a width direction of the antenna, and a minor axis direction of the quasi-ellipse is used as a thickness direction of the antenna. Because a minor axis of the quasi-ellipse is less than a major axis, when the dielectric lens is applied to the multi-beam antenna, an increased size in the thickness direction of the multi-beam antenna can meet a size requirement of the multi-beam antenna. Compared with a conventional cylindrical Luneberg lens antenna, a thickness of the lens is reduced using the multi-beam antenna.

With reference to the second aspect, in a first possible implementation of the second aspect, a connection between the plurality of units is any one of welding, gluing, structural clamping, and a connection printed using a 3D printing technology. A process of preparing the plurality of units is any one of extrusion, injection, molding, CNC machining, and a 3D printing process technology.

With reference to the second aspect or the first possible implementation of the second aspect, in a second possible implementation of the second aspect, the unit is a solid first polyhedron.

Optionally, the first polyhedron is a regular polyhedron. For example, the first polyhedron is a regular tetrahedron or a regular octahedron.

Optionally, the first polyhedron is an inscribed polyhedron of a first sphere, a diameter of the first sphere is denoted as d1, and 1 mm<d1<450 mm.

Optionally, the first polyhedron is an inscribed polyhedron of a first ellipsoid of revolution, a major axis of the first ellipsoid of revolution is denoted as d1a, a minor axis of the first ellipsoid of revolution is denoted as d1b, and 1 mm≤d1b<d1a≤450 mm.

With reference to the second aspect or the first possible implementation of the second aspect, in a third possible implementation of the second aspect, the unit is a hollow unit, an outer profile of the unit is a second polyhedron, and an inner profile is a third polyhedron.

Optionally, the second polyhedron is a regular polyhedron, and/or the third polyhedron is a regular polyhedron.

Optionally, a quantity of faces of the second polyhedron and a quantity of faces of the third polyhedron may be equal or unequal.

Optionally, the second polyhedron is an inscribed polyhedron of a second sphere, the third polyhedron is an inscribed polyhedron of a third sphere, a diameter of the second sphere is denoted as d2, a diameter of the third sphere is denoted as d3, and 1 mm≤d3<d2≤450 mm.

Optionally, the second polyhedron is an inscribed polyhedron of a second ellipsoid of revolution, the third polyhedron is an inscribed polyhedron of a third ellipsoid of revolution, a major axis of the second ellipsoid of revolution is denoted as d2a, a minor axis of the second ellipsoid of revolution is denoted as d2b, a major axis of the third ellipsoid of revolution is denoted as d3a, and a minor axis of the third ellipsoid of revolution is denoted as d3b, where 1 mm≤d3a<d2a≤450 mm, 1 mm≤d3b<d2b≤450 mm, d2a>d2b, and d3a>d3b.

With reference to the second aspect or the first possible implementation of the second aspect, in a fourth possible implementation of the second aspect, the unit is a solid unit, the unit is a fourth sphere or a fourth ellipsoid of revolution, a diameter of the fourth sphere is denoted as d4, a major axis of the fourth ellipsoid of revolution is denoted as d4a, and a minor axis of the fourth ellipsoid of revolution is denoted as d4b, where 1 mm≤d4≤450 mm, and 1 mm≤d4b<d4a≤450 mm.

With reference to the second aspect or the first possible implementation of the second aspect, in a fifth possible implementation of the second aspect, the unit is a hollow unit, an outer profile of the unit is a fifth ellipsoid of revolution, an inner profile is a sixth ellipsoid of revolution, a major axis of the fifth ellipsoid of revolution is denoted as d5a, a minor axis of the fifth ellipsoid of revolution is denoted as d5b, a major axis of the sixth ellipsoid of revolution is denoted as d6a, and a minor axis of the sixth ellipsoid of revolution is denoted as d6b, where 1 mm≤d6a<d5a≤450 mm, 1 mm≤d6b<d5b≤450 mm, d5a>d5b, and d6a>d6b.

According to a third aspect, a multi-beam antenna is provided, and includes a radome, a dielectric lens, a reflection panel, and a dipole array.

The dielectric lens is disposed between the radome and the dipole array, and the dipole array is used as a feed of the dielectric lens.

The dipole array is disposed between the dielectric lens and the reflection panel, and a feeding network required by the dipole array is disposed on a back facet of the reflection panel or is integrated into the reflection panel.

The dielectric lens has a first size in a thickness direction of the multi-beam antenna, the dielectric lens has a second size in a width direction of the multi-beam antenna, and the first size is less than the second size.

With reference to the third aspect, in an implementation of the third aspect, the dielectric lens is the dielectric lens according to any one of the first aspect or the possible implementations of the first aspect, or the dielectric lens is the dielectric lens according to any one of the second aspect or the possible implementations of the second aspect.

DESCRIPTION OF EMBODIMENTS

The following describes the technical solutions in the embodiments of this application with reference to the accompanying drawings in the embodiments of this application.

Figure 1:
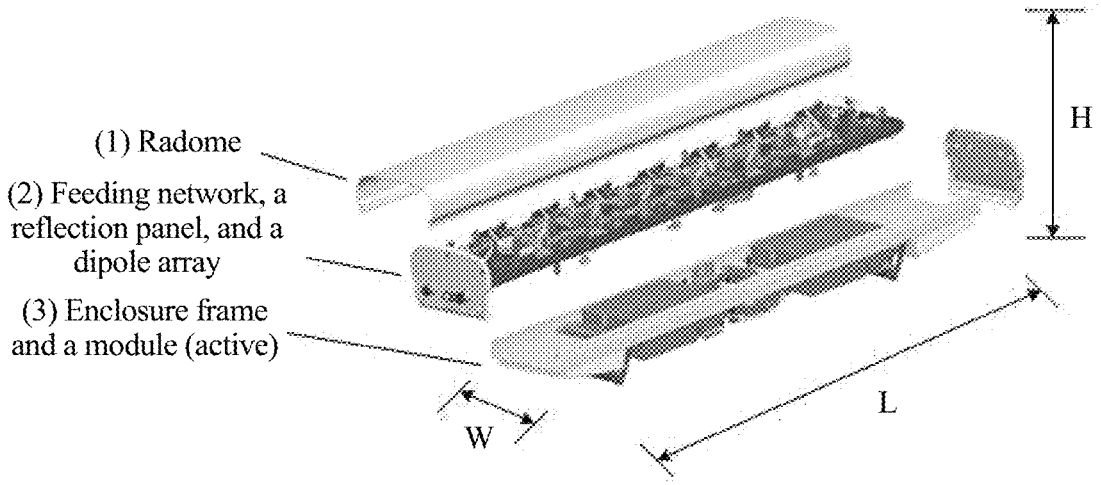
FIG. 1 is a schematic diagram of a conventional antenna.

FIG. 1 is a schematic diagram of a conventional antenna. The conventional antenna in FIG. 1 includes (1) a radome, (2) a feeding network, a reflection panel, and a dipole array, and (3) an enclosure frame and a module (active). In addition, FIG. 1 further shows dimensions of the antenna, which are a width (W), a thickness (H), and a length (L) respectively.

With substantial increase of users, a current network is faced with problems such as frequency resource restriction, channel capacity restriction, increased difficulties in obtaining site resources, near-far effect, system interference, and severe congestion of some cells. A multi-beam antenna technology is intended to increase a system capacity of a mobile communications system and improve communication quality of the system, and is a technical solution having a desired application prospect. Currently, a method for designing a multi-beam antenna is to feed a multi-column antenna using a Butler matrix to form a plurality of beams in a horizontal direction. In this way, a resource restriction problem can be resolved. The horizontal direction herein is a width direction of the antenna. However, when more beams need to be split, an increasing quantity of antenna columns are required accordingly. Consequently, a width of the antenna is quite large. However, an excessively large width (for example, greater than 450 mm) brings difficulties to actual installation and layout.

Figure 2:
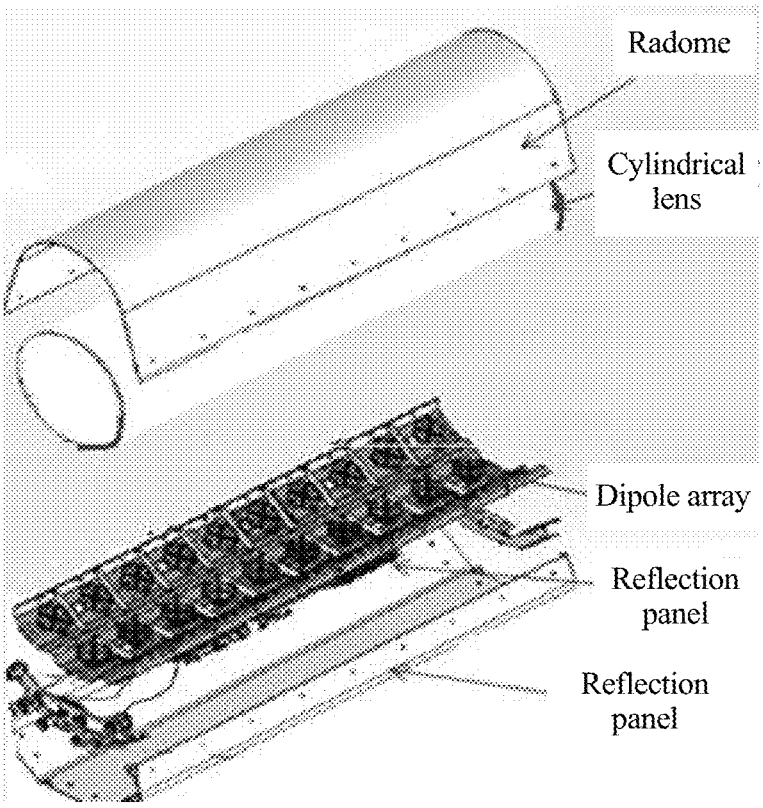
FIG. 2 is a schematic diagram of a multi-beam antenna using a Luneberg lens.

To reduce the width of the antenna while ensuring that the antenna has a plurality of incoherent beams in a horizontal dimension, as shown in FIG. 2, an electromagnetic lens, namely, a "Luneberg lens" is added between (1) the radome and (2) the feeding network, the reflection panel, and the dipole array shown in FIG. 1. In this way, non-plane waves respectively sent by a plurality of feeds may be converted into plane waves using a change of a relative dielectric constant of lens materials in order to form a plurality of beams. It can be learned that, using the electromagnetic lens, the plurality of beams may be formed in the horizontal direction without increasing the width of the antenna.

Figure 3:
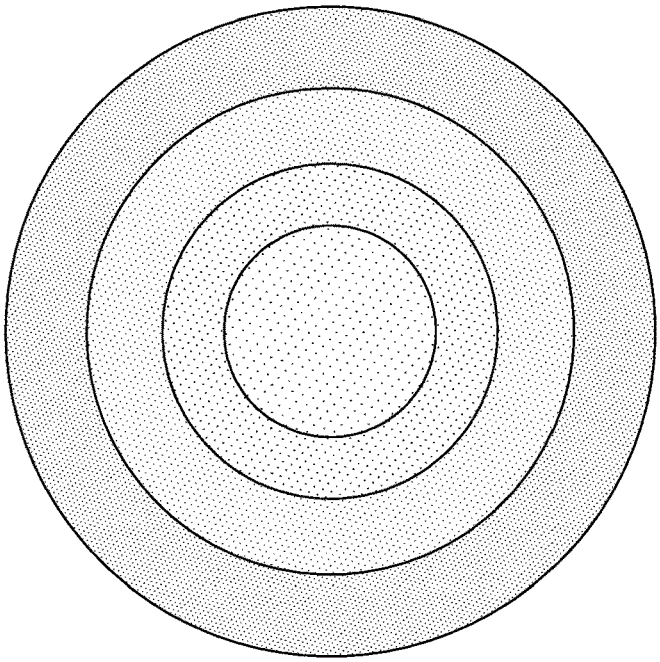
FIG. 3 is a schematic diagram of dielectric constant distribution of a Luneberg lens in FIG. 2.

A cylindrical lens shown in FIG. 2 is the Luneberg lens. FIG. 3 is a schematic diagram of cross-sectional dielectric constant distribution of a cylindrical lens in FIG. 2. Different grayscales represent different dielectric constants, and a same color or grayscale represents one dielectric constant value.

With reference to an appropriate feed system, the Luneberg lens with a circular cross section may achieve good multi-beam performance. A width of the antenna may be within 450 mm. However, because the cross section of the cylindrical lens is circular, using the cylindrical lens certainly increases a thickness of the multi-beam antenna. Further, when the cylindrical lens is integrated into the feed system, the thickness of the antenna is quite large. The thickness is usually greater than 400 mm.

Figure 4:
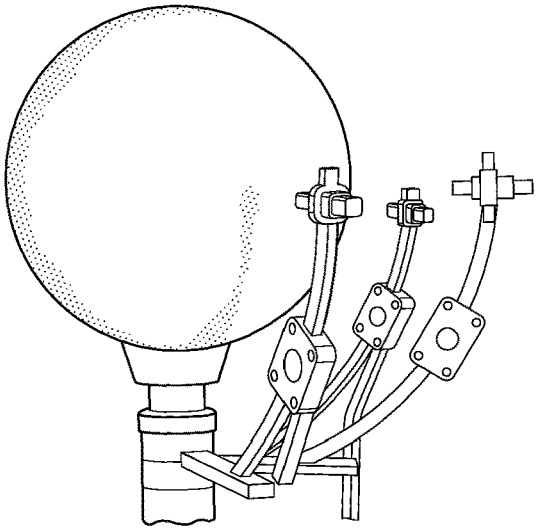
FIG. 4 is another schematic diagram of a multi-beam antenna using a Luneberg lens.

Similar to the cylindrical lens in FIG. 2, in actual application, an electromagnetic lens of this type is also designed to be spherical. As shown in FIG. 4, the spherical lens may be placed in a spherical radome. The spherical lens is made of several layers of concentric spherical shell materials with different dielectric constants, and dielectric constants of the layers are the same. However, an antenna using the spherical lens is quite large, and a currently known diameter of the spherical lens is greater than or equal to 800 mm.

Figure 5:
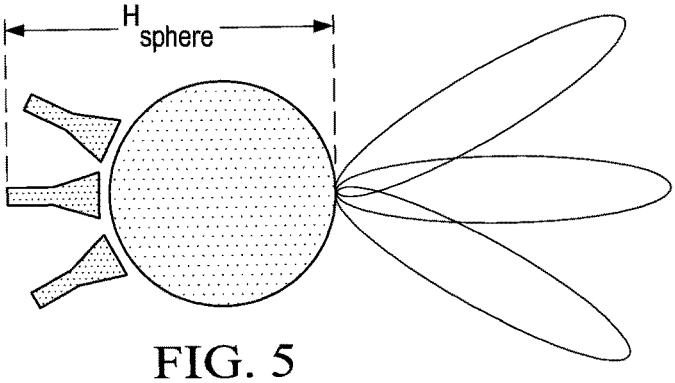
FIG. 5 is a schematic diagram in which a Luneberg lens converts a non-plane wave into a plane wave.

It can be learned that the current solution is to convert a non-plane wave radiated by a feed into a plane wave using the Luneberg lens with the circular cross section, i.e., a plurality of radiation beams may be formed through multi-column feed irradiation. The schematic principle is shown in FIG. 5. However, the current solution has disadvantages such as a high antenna cross section and a difficulty in producing materials that meet specific dielectric constant distribution.

Further, because the Luneberg lens is in a cylindrical shape, the width may be effectively reduced in a width dimension when a plurality of multi-beams is implemented.

However, in a thickness dimension, because there are a radome, a lens, a feed, a reflection panel, a feeding network, a rear cover, and the like, an overall thickness of the antenna is greatly increased objectively. In a specific case, it is difficult for a user to accept. In addition, lens materials of the existing solution are implemented by doping metal particles in polymers such that dielectric constant spatial distribution of the materials meets lens requirements. In this method, one-time foam forming is implemented based on a specific configuration between polymers and metal particles, and it is difficult to control precision of the dielectric constant distribution. When the dielectric constant distribution of the lens changes, the materials need to be reconfigured for producing.

A high-gain split multi-sector is a Universal Mobile Telecommunication System (UMTS)/Long Term Evolution (LTE) key solution in a W3 market, and is also an important direction to build corporate antenna competitiveness. The high-gain split multi-sector is an important subject for maximizing a site capacity, and laying a foundation for development of a radio space division technology. Lightweight and miniaturized antenna design is a problem to be urgently resolved.

Figure 6:
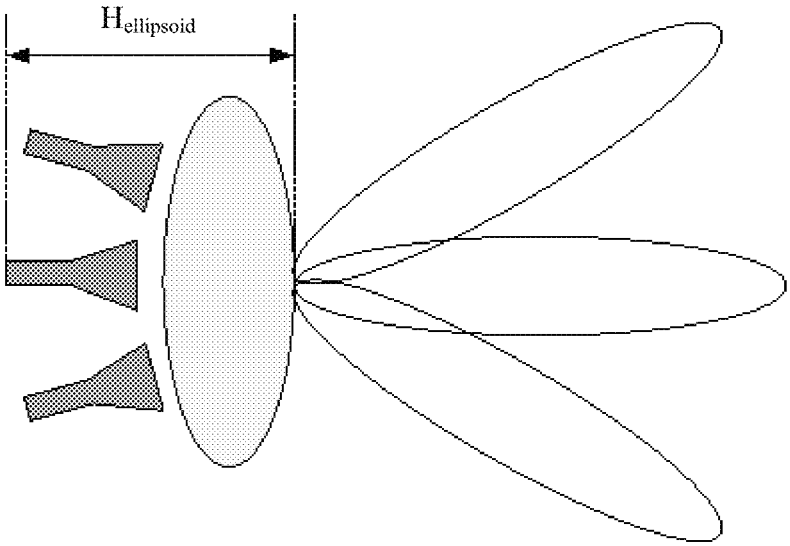
FIG. 6 is a schematic diagram of a dielectric lens principle according to an embodiment of this application.

For a plurality of multi-beam lens antennas, an embodiment of this application provides a dielectric lens. The dielectric lens can be used as an electromagnetic lens applied to a multi-beam antenna. The dielectric lens has an elliptical cross section, and can implement performance the same as that of a lens with a circular cross section. As shown in FIG. 6, the dielectric lens may enable a non-plane wave sent by a feed in a minor axis direction of the ellipse to be converted into a plane wave through the dielectric lens.

Figure 7:
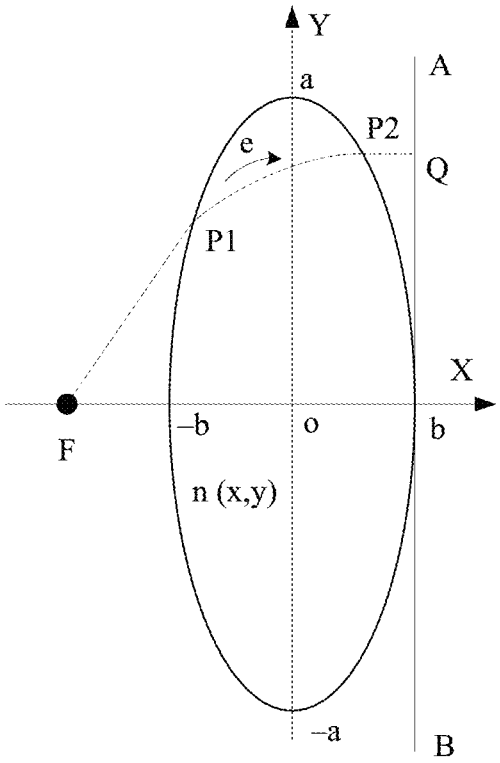
FIG. 7 is a schematic diagram of a geometrical relationship between electromagnetic ray transmission paths of a cross section of an elliptical lens.

FIG. 7 is a schematic diagram of a geometrical relationship between electromagnetic ray transmission paths of a cross section of an elliptical lens. The cross section of the lens is an ellipse, a major axis of the ellipse is 2a, a minor axis is 2b, refractive index distribution of lens materials is n(x, y), and a feed phase center is located at a focal point F of the lens. To enable a radiation aperture of the lens to be more efficient, a plane A and a plane B need to be equiphase surfaces, i.e., rays such as $FP_1P_2Q$ starting from the point F are equipotential. The following equation is met:

$$\begin{cases} FP_1 + \int_{P_1}^{P_2} n(x, y)ds + P_2Q = const \\ \delta \int_{P_1}^{P_2} n(x, y)ds = 0 \end{cases},$$

where δ is a variation operator, and const represents a constant.

In addition, further, when the dielectric lens is applied to a multi-beam antenna, a major axis direction of the ellipse is in a width direction of the antenna, and a minor axis direction of the ellipse is in a thickness direction of the antenna. Because the minor axis of the ellipse is less than the major axis, the multi-beam antenna can meet a size requirement in a thickness direction while meeting a width requirement in order to implement lightweight and miniaturization of the multi-beam antenna. The following describes the dielectric lens in detail.

The dielectric lens in this embodiment of this application may be a cylindrical lens or a quasi-ellipsoidal lens, and can be applied to an antenna in a corresponding shape. It can be understood that the dielectric lens may also be in another shape, for example, may be a frustum of a cone-like lens. No enumeration is provided herein.

Figure 8:
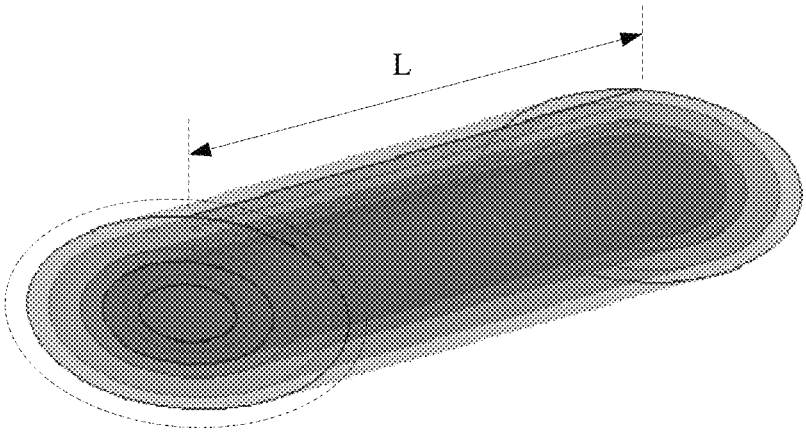
FIG. 8 is a schematic diagram of a dielectric lens according to an embodiment of this application.

FIG. 8 is a schematic diagram of a dielectric lens according to an embodiment of this application. The dielectric lens shown in FIG. 8 is a cylindrical lens, and a cross-sectional profile of the cylindrical lens is a quasi-ellipse.

In this embodiment of this application, the quasi-ellipse (quasi-elliptic) is an approximate ellipse.

A length of the cylindrical lens may be denoted as L, and it can be understood that a cross section is a section perpendicular to a length direction.

The cylindrical lens may have two end faces, a first end face and a second end face. Both the first end face and the second end face are planes, and the first end face and the second end face are parallel.

Further, the first end face and the second end face are two outermost surfaces perpendicular to the length direction of the cylindrical lens. Optionally, the foregoing cross section may be any face parallel to the first end face (or the second end face). For example, the foregoing cross section may be the first end face (or the second end face).

The cylindrical lens is formed by piling a plurality of cylindrical units, and dielectric constant distribution of the plurality of cylindrical units in the dielectric lens enables a non-plane wave in a minor axis direction of the quasi-ellipse to be converted into a plane wave after passing through the lens. A length of each cylindrical unit is equal to the length of the cylindrical lens.

Optionally, the cylindrical lens is formed by tightly piling the plurality of cylindrical units horizontally. Optionally, the dielectric constant distribution may be obtained through numerical fitting based on Fermat's principle and Snell's law.

In other words, the length of each cylindrical unit may also be denoted as L. Optionally, 100 mm≤L≤3500 mm. It should be noted that a value of L may be any value between 100 mm and 3500 mm. This is not limited in this application. For example, L=2500 mm, or L=3000 mm.

The cylindrical unit may have two parallel end faces, and the two parallel end faces may be respectively located on the first end face and the second end face.

A connection manner between the plurality of cylindrical units is at least one of welding, gluing, structural clamping, and a connection printed using a 3D printing technology.

The welding may be ultrasonic welding or diffusion welding, or may be welding of another form. This is not limited in this application.

In addition, a connection manner between a plurality of cylindrical units in a same cylindrical lens may be the same or different. For example, a connection manner between some cylindrical units is welding, and a connection manner between some other cylindrical units is gluing. For example, a connection manner between some cylindrical units is ultrasonic welding, and a connection manner between some other cylindrical units is diffusion welding.

It can be understood that end faces of the plurality of cylindrical units may be aligned. For example, each cylindrical unit has two end faces, which are denoted as an end face A and an end face B. Therefore, end faces A of the cylindrical units are aligned, and end faces B of the cylindrical units are aligned.

The cross section of the cylindrical lens is the quasi-ellipse, and the quasi-ellipse herein includes an ellipse. The cross section of the cylindrical lens may be the ellipse. The length of the cylindrical lens may be denoted as L, a major axis of the quasi-ellipse may be denoted as Da, and a minor axis may be denoted as Db. 100 mm≤L≤3500 mm, 1 mm≤Db<Da≤450 mm, and usually, Db<Da≤L.

It should be noted that for Da and Db, Db<Da, and values of both Da and Db may be any value between 1 mm and 450 mm. This is not limited in this application. For example, Da=400 mm, or Db=350 mm. A ratio between Da and Db is not limited in this embodiment of this application. For example, Db=2×Da, or Db=10×Da.

The unit may be a solid unit or a hollow unit. It can be understood that the plurality of cylindrical units forming the dielectric lens may be all solid units or may be all hollow units, or some may be solid units and some may be hollow units.

From a perspective of one unit, in an embodiment, the unit may be a solid unit, and a cross section of the unit may be a first polygon.

The first polygon may be a regular polygon, or the first polygon is a non-regular polygon.

Optionally, the plurality of cylindrical units forming the dielectric lens may be all solid units. Cross sections (namely, first polygons) of the plurality of cylindrical units may be all regular polygons. Alternatively, cross sections of the plurality of cylindrical units may be all non-regular polygons. Alternatively, cross sections of some of the plurality of cylindrical units are regular polygons, and cross sections of some units are non-regular polygons. This is not limited in this application.

Optionally, the first polygon may be a polygon having a first circumcircle, i.e., the first polygon may be an inscribed polygon of the first circle. A diameter of the first circle may be denoted as D1, and 1 mm≤D1≤450 mm. It should be noted that a size of D1 may also be another value. This is not limited herein. Usually, D1<Db<Da.

It should be noted that 1 mm≤D1≤450 mm indicates that the value of D1 may be any value between 1 mm and 450 mm. This is not limited in this application. For example, 1 mm≤D1≤100 mm, D1=2 mm, or D1=150 mm.

Figure 9:
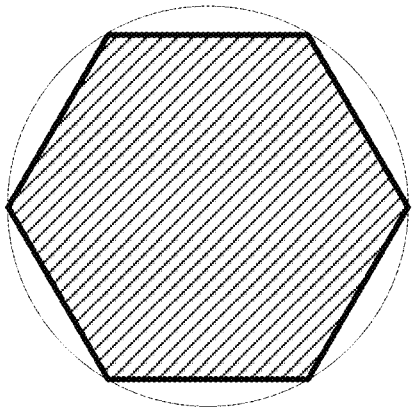
FIG. 9 is a schematic diagram of a cross section of a unit of a cylindrical lens according to an embodiment of this application.

FIG. 9 shows an example of the cross section of the unit, and the first polygon shown in FIG. 9 is a regular hexagon.

If the first polygon is the regular polygon, and a quantity of sides of the first polygon is greater than a preset first threshold, the first polygon may be approximated as a circle. The approximate circle is the circumcircle of the first polygon, namely, the first circle. The cross section of the unit may be circular. For example, the first threshold may be equal to 12 or 20.

Optionally, the first polygon may be a polygon having a first circumscribed ellipse, i.e., the first polygon may be an inscribed polygon of the first ellipse. A major axis of the first ellipse is denoted as D1a, a minor axis of the first ellipse is denoted as D1b, and 1 mm≤D1b<D1a≤450 mm. It should be noted that sizes of D1a and D1b may also be other values. This is not limited herein. Usually, D1b≤Db, and D1a≤Da.

It should be noted that for D1a and D1b, D1b<D1a, and values of both D1a and D1b may be any value between 1 mm and 450 mm. This is not limited in this application. For example, 1 mm≤D1b<D1a≤100 mm, or D1a=15 mm and D1b=2 mm.

Figure 10:
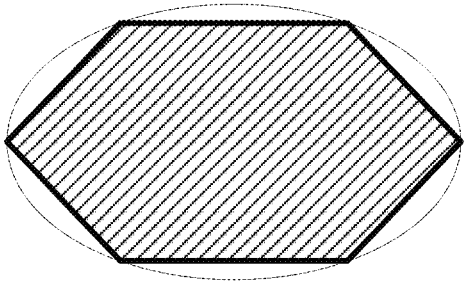
FIG. 10 is a schematic diagram of a cross section of a unit of a cylindrical lens according to another embodiment of this application.

FIG. 10 shows another example of the cross section of the unit, the first polygon shown in FIG. 10 is a hexagon, and the first polygon shown in FIG. 10 is a non-regular polygon.

If the first polygon is a polygon having a first symmetry axis and a second symmetry axis, the first symmetry axis is the major axis of the first ellipse, and the second symmetry axis is the minor axis of the first ellipse, when a quantity of sides of the first polygon is greater than a preset second threshold, the first polygon may be approximated as an ellipse. The approximate ellipse is the circumscribed ellipse of the first polygon, namely, the first ellipse. The cross section of the unit may be elliptical. For example, the second threshold may be equal to 12 or 20.

From a perspective of one unit, in another embodiment, the unit may be a solid unit, and a cross section of the unit may be a first circle or a first ellipse.

A diameter of the first circle is denoted as D1, and 1 mm≤D1≤450 mm. Alternatively, a major axis of the first ellipse is denoted as D1a, a minor axis of the first ellipse is denoted as D1b, and 1 mm≤D1b<D1a≤450 mm.

It should be noted that a value of D1 may be any value between 1 mm and 450 mm. This is not limited in this application. For example, 1 mm≤D1≤100 mm, or D1=5 mm. Usually, D1<Db<Da.

It should be noted that for D4a and D4b, D4b<D4a, and values of both D4a and D4b may be any value between 1 mm and 450 mm. This is not limited in this application. For example, 1 mm≤D1b<D1a≤100 mm, or D4a=20 mm and D4b=5 mm. Usually, D1b≤Db, and D1a≤Da.

From a perspective of one unit, in another embodiment, the unit may be a hollow unit, an outer profile of a cross section of the unit is a second polygon, and an inner profile is a third polygon. A quantity of sides of the second polygon and a quantity of sides of the third polygon may be equal or unequal.

The second polygon may be a regular polygon, or the second polygon is a non-regular polygon. The third polygon may be a regular polygon, or the third polygon is a non-regular polygon.

Optionally, the second polygon is a regular polygon, the third polygon is a regular polygon, and a quantity of sides of the second polygon and a quantity of sides of the third polygon are equal or unequal. In this case, the second polygon and the third polygon may have a same symmetry axis or different symmetry axes. Optionally, the second polygon is a regular polygon, the third polygon is a non-regular polygon, and a quantity of sides of the second polygon and a quantity of sides of the third polygon are equal or unequal. Optionally, the second polygon is a non-regular polygon, the third polygon is a regular polygon, and a quantity of sides of the second polygon and a quantity of sides of the third polygon are equal or unequal. Optionally, the second polygon is a non-regular polygon, the third polygon is a non-regular polygon, and a quantity of sides of the second polygon and a quantity of sides of the third polygon are equal or unequal.

In this embodiment of this application, the second polygon may be an inscribed polygon of a second circle or a second ellipse, and the third polygon may be an inscribed polygon of a third circle or a third ellipse.

Optionally, the second polygon may be a polygon having a second circumcircle, i.e., the second polygon may be an inscribed polygon of the second circle. The third polygon may be a polygon having a third circumcircle, i.e., the third polygon may be an inscribed polygon of the third circle. The second circle and the third circle may be concentric circles, or may not be concentric circles.

A diameter of the second circle may be denoted as D2, and a diameter of the third circle may be denoted as D3, and 1 mm≤D3<D2≤450 mm. It should be noted that sizes of D2 and D3 may also be other values. This is not limited herein. Usually, D3<D2<Db<Da.

It should be noted that for D3 and D2, D3<D2, and values of both D3 and D2 may be any value between 1 mm and 450 mm. This is not limited in this application. For example, 1 mm≤D3<D2≤100 mm. For another example, D2=180 mm, and D3=100 mm.

Figure 11:
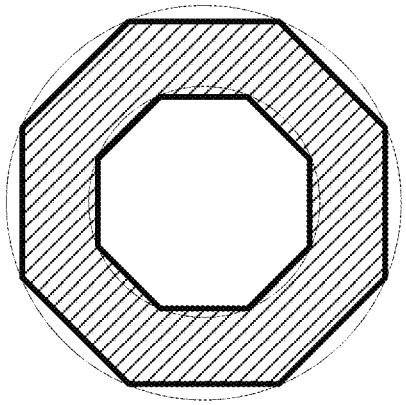
FIG. 11 is a schematic diagram of a cross section of a unit of a cylindrical lens according to still another embodiment of this application.

FIG. 11 shows still another example of the cross section of the unit, the second polygon shown in FIG. 11 is a regular octagon, and the third polygon is a regular octagon.

It should be noted that, although a quantity of sides of the second polygon and a quantity of sides of the third polygon are equal, and each side of the second polygon is parallel to a corresponding side of the third polygon, FIG. 11 should not be considered as a limitation on locations of the second polygon and the third polygon. For example, the third polygon in FIG. 11 may be rotated by any angle such as 10° or 20°, which still falls within the protection scope of this embodiment of this application.

Figure 12:
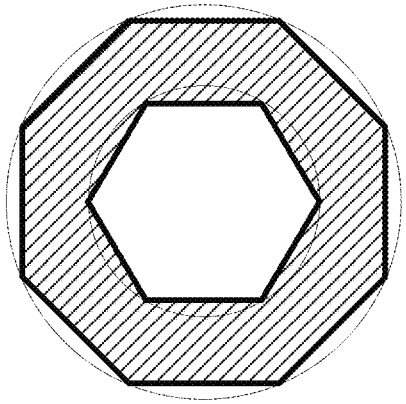
FIG. 12 is a schematic diagram of a cross section of a unit of a cylindrical lens according to still another embodiment of this application.

FIG. 12 shows still another example of the cross section of the unit, the second polygon shown in FIG. 12 is a regular octagon, and the third polygon is a regular hexagon. It can be learned that in FIG. 12, a quantity of sides of the second polygon and a quantity of sides of the third polygon are unequal.

If the second circle and the third circle are concentric circles, both the second polygon and the third polygon are regular polygons, and both a quantity of sides of the second polygon and a quantity of sides of the third polygon are greater than a preset third threshold, both the second polygon and the third polygon may be approximated as a circle. The quantity of sides of the second polygon and the quantity of sides of the third polygon may be equal or unequal. In this case, the second polygon is approximated as the second circle, and the third polygon is approximated as the third circle. The cross section of the unit may be ring-shaped. For example, the third threshold may be equal to 12 or 20.

Optionally, the second polygon may be a polygon having a second circumscribed ellipse, i.e., the second polygon may be an inscribed polygon of the second ellipse. The third polygon may be a polygon having a third circumscribed ellipse, i.e., the third polygon may be an inscribed polygon of the third ellipse.

A major axis of the second ellipse is denoted as D2a, and a minor axis of the second ellipse is denoted as D2b. A major axis of the third ellipse is denoted as D3a, and a minor axis of the third ellipse is denoted as D3b. 1 mm<D3a<D2a≤450 mm, 1 mm≤D3b<D2b<450 mm, D2a>D2b, and D3a>D3b. It should be noted that sizes of D2a, D2b, D3a, and D3b may also be other values. This is not limited herein. Usually, D3b<D2b≤Db, and D3a<D2a≤Da.

It should be noted that for D2a, D2b, D3a, and D3b, D3a<D2a, D3b<D2b, D2a>D2b, and D3a>D3b, and values of D2a, D2b, D3a, and D3b may be any value between 1 mm and 450 mm. This is not limited in this application. For example, D2a=180 mm, D2b=100 mm, D3a=80 mm, and D3b=40 mm.

Figure 13:
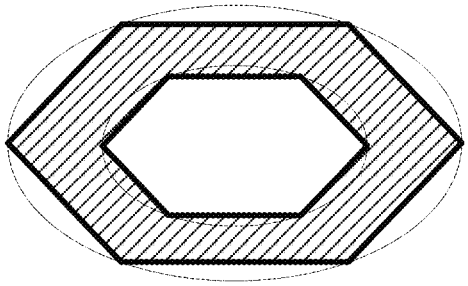
FIG. 13 is a schematic diagram of a cross section of a unit of a cylindrical lens according to still another embodiment of this application.

FIG. 13 shows still another example of the cross section of the unit, and both the second polygon and the third polygon shown in FIG. 13 are hexagons.

It should be noted that a quantity of sides of the second polygon and a quantity of sides of the third polygon may alternatively be unequal. No enumeration is provided herein. In addition, although a major axis direction of the second ellipse shown in FIG. 13 is consistent with a major axis direction of the third ellipse, FIG. 13 should not be considered as a limitation on this case. Further, there may be a specific angle between the major axis direction of the second ellipse and the major axis direction of the third ellipse. This is not limited in this application.

If the major axis direction of the second ellipse is consistent with that of the third ellipse, and centers of the second ellipse and the third ellipse are a same point, both the second polygon and the third polygon are polygons having a first symmetry axis and a second symmetry axis, the first symmetry axis is the major axis of the second ellipse (or the third ellipse), and the second symmetry axis is the minor axis of the second ellipse (or the third ellipse). In this case, when both a quantity of sides of the second polygon and a quantity of sides of the third polygon are greater than a preset fourth threshold, the second polygon may be approximated as the second ellipse, and the third polygon is approximated as the third ellipse. The cross section of the unit may be elliptical ring-shaped. For example, the fourth threshold may be equal to 12 or 20.

Optionally, the second polygon may be a polygon having a second circumscribed ellipse, i.e., the second polygon may be an inscribed polygon of the second ellipse. The third polygon may be a polygon having a third circumcircle, i.e., the third polygon may be an inscribed polygon of the third circle.

A major axis of the second ellipse is denoted as D2a, and a minor axis of the second ellipse is denoted as D2b. A diameter of the third circle is denoted as D3. 1 mm<D3<D2b<D2a≤450 mm. It should be noted that sizes of D3, D2a, and D2b may also be other values. This is not limited herein. Usually, D3<D2b≤Db, and D2a≤Da.

It should be noted that for D2a, D2b, and D3, D3<D2b<D2a, and values of D2a, D2b, and D3 may be any value between 1 mm and 450 mm. This is not limited in this application. For example, D2a=180 mm, D2b=100 mm, and D3=80 mm.

Figure 14:
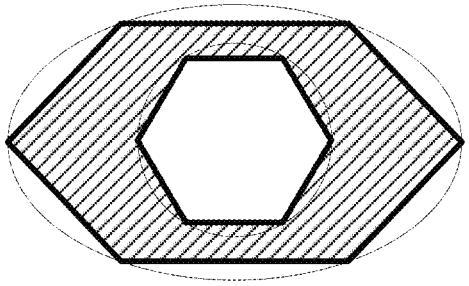
FIG. 14 is a schematic diagram of a cross section of a unit of a cylindrical lens according to still another embodiment of this application.

FIG. 14 shows still another example of the cross section of the unit, the second polygon shown in FIG. 14 is a hexagon having a circumscribed ellipse, and the third polygon is a regular hexagon having a circumcircle.

Optionally, the second polygon may be a polygon having a second circumcircle, i.e., the second polygon may be an inscribed polygon of the second circle. The third polygon may be a polygon having a third circumscribed ellipse, i.e., the third polygon may be an inscribed polygon of the third ellipse.

A diameter of the second circle is denoted as D2, a major axis of the third ellipse is denoted as D3a, and a minor axis of the third ellipse is denoted as D3b. 1 mm<D3b<D3a<D2≤450 mm. It should be noted that sizes of D2, D3a, and D3b may also be other values. This is not limited herein. Usually, D2≤Db.

It should be noted that for D2, D3a, and D3b, D3b<D3a<D2, and values of D2, D3a, and D3b may be any value between 1 mm and 450 mm. This is not limited in this application. For example, D2=150 mm, D3a=100 mm, and D3b=80 mm.

From a perspective of one unit, in another embodiment, the unit may be a hollow unit, an outer profile of a cross section of the unit is a fifth circle or a fifth ellipse, and an inner profile is a sixth circle or a sixth ellipse. A diameter of the fifth circle is denoted as D5, and a diameter of the sixth circle is denoted as D6. A major axis of the fifth ellipse is denoted as D5a, a minor axis of the fifth ellipse is denoted as D5b, a major axis of the sixth ellipse is denoted as D6a, and a minor axis of the sixth ellipse is denoted as D6b. 1 mm≤D6<D5≤450 mm, 1 mm<D6a<D5a≤450 mm, 1 mm≤D6b<D5b<450 mm, D5a>D5b, and D6a>D6b.

Optionally, the outer profile is the fifth circle, and the inner profile is the sixth circle. Usually, D6<D5<Db<Da.

Optionally, the outer profile is the fifth circle, and the inner profile is the sixth ellipse. Usually, D6b<D6a<D5<Db<Da.

Optionally, the outer profile is the fifth ellipse, and the inner profile is the sixth circle. Usually, D6<D5b≤Db, and D5a≤Da.

Optionally, the outer profile is the fifth ellipse, and the inner profile is the sixth ellipse. Usually, D6b<D5b≤Db, and D6a<D5a≤Da.

It should be noted that, although value ranges of D1, D2, D3, D4, D5, D6, D1b, D1a, D2b, D2a, D3b, D3a, D4b, D4a, D5b, D5a, D6b, and D6a are provided as an example in the foregoing embodiment, the ranges are not limited in this application. For example, respective ranges may also be as follows 1 mm≤D1≤200 mm, 1 mm≤D3<D2≤200 mm, 1 mm≤D4≤200 mm, 1 mm≤D6<D5≤200 mm, 10 mm≤D1b<D1a≤100 mm, 1 mm<D3a<D2a≤200 mm, 1 mm≤D3b<D2b<200 mm, 10 mm≤D4b<D4a≤100 mm, 1 mm<D6a<D5a≤200 mm, 1 mm≤D6b<D5b<200 mm, and the like. In addition, each value may be any value within its range, and no enumeration is provided herein.

It can be understood that in this embodiment of this application, the cross section of the unit may also be another polygon in an irregular shape. For example, the cross section of the unit may be a fourth polygon, and the fourth polygon has neither a circumcircle nor a circumscribed ellipse. No enumeration is provided herein.

In addition, in this embodiment of this application, cross sections of the plurality of units are all the same, or cross sections of some units are the same or different. For example, cross sections of some of the plurality of units are inscribed second polygons of the first circle, and cross sections of some other units are inscribed third polygons of the first ellipse. This is not limited in this application.

Figure 15:
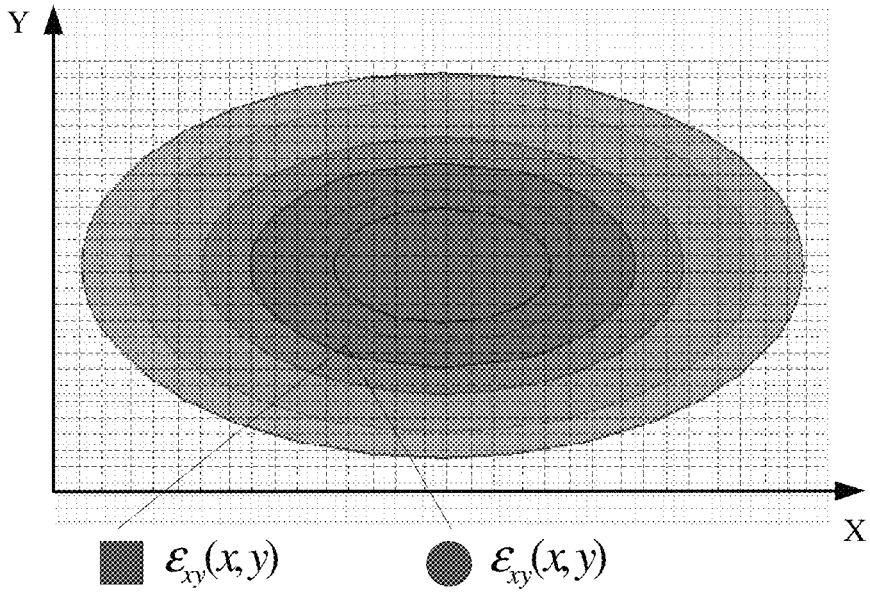
FIG. 15 is a schematic diagram of dielectric constant distribution of a cross section of a cylindrical lens according to still another embodiment of this application.

It can be learned that the cylindrical lens is formed by tightly piling the plurality of cylindrical units. FIG. 15 shows a cross section of the cylindrical lens, and the cross section of the cylindrical lens is a quasi-ellipse. FIG. 15 further shows a major axis Da and a minor axis Db of the quasi-ellipse. The cross section of the unit may be a square (namely, a regular quadrangle) or a circle (for example, a first regular polygon whose side length is greater than a first threshold). It can be understood that, because the cross section of the unit is a polygon, a person skilled in the art may understand that the quasi-ellipse described in this embodiment of this application is an approximate ellipse.

A cross-sectional shape of the unit of the cylindrical lens is mainly described above with reference to the embodiments in FIG. 9 to FIG. 14. In addition, the dielectric constant distribution of the plurality of units in the cylindrical lens should enable the non-plane wave sent by the feed in the minor axis direction of the quasi-ellipse serving as the cross section of the cylindrical lens to be converted into the plane wave through the dielectric lens.

It is assumed that there is a coordinate axis XY. As shown in FIG. 15, the cross section of the cylindrical lens is located on a plane of the coordinate axis XY, and a dielectric constant of the unit may be denoted as $\varepsilon_{xy}$ (x, y). The dielectric constant of the unit is related to a location of the unit in the cylindrical lens. Further, the dielectric constant of the unit is $\varepsilon_{xy}$(x, y), which indicates that the dielectric constant ε is related to coordinates x and y, coordinates x and y may be center-of-mass coordinates of the cross section of the unit.

In specific implementation, a dielectric constant of each unit is allowed within an error range. For example, assuming that a dielectric constant of a unit A is $\varepsilon_0$, a value of a dielectric constant at any point in the unit may be within an error range around $\varepsilon_0$. For example, if the error range is 10%, the value of the dielectric constant at any point in the unit may be within a range of $\varepsilon_0-\varepsilon_0\times10\%$ to $\varepsilon_0+\varepsilon_0\times10\%$.

Further, an embodiment of this application further provides a dielectric lens manufacturing method. The manufacturing method may include using printed powder or ink having different dielectric constants to obtain a mixture corresponding to each unit in the dielectric lens, where the mixture meets a dielectric constant of a corresponding unit, and dielectric constant distribution of each unit in the dielectric lens is determined through numerical fitting based on Fermat's principle and Snell's law such that a non-plane wave in a minor axis direction of the quasi-ellipse is converted into a plane wave through the dielectric lens, and generating the dielectric lens using the mixture.

Optionally, the method may be performing numerical fitting based on Fermat's principle and Snell's law to determine dielectric constant distribution of each unit in the dielectric lens such that a non-plane wave in a minor axis direction of the quasi-ellipse is converted into a plane wave through the dielectric lens, further, using printed powder or ink having different dielectric constants to obtain a mixture corresponding to each unit in the dielectric lens, where the mixture meets a dielectric constant of a corresponding unit, and generating the dielectric lens using the mixture.

Further, a size of the dielectric lens may be first determined based on an actual requirement of the multi-beam antenna, and a quantity, a size, a shape, and the like of the unit are determined based on the size of the dielectric lens. Further, numerical fitting may be performed based on Fermat's principle and Snell's law, to determine the dielectric constant distribution. For example, modeling may be performed through COMSOL, to obtain the dielectric constant of each unit. It can be learned that the dielectric constant in the dielectric lens may be designed as required, and spatial distribution of the dielectric constant may be determined based on numerical simulation.

It can be understood that if there is a gap between units, for example, a cross section of the unit is circular or elliptical, the gap between the units may be considered as air in a numerical fitting process, and the unit has a dielectric constant of the air. The gap between the units may be considered as a "special unit" having the dielectric constant of the air.

For another example, if the unit is a hollow cylindrical unit, it may be considered that a hollow area is air, and the unit has a dielectric constant of the air. The hollow area "is filled with" a "special unit" having the dielectric constant of the air.

Optionally, the method may be performing numerical fitting based on Fermat's principle and Snell's law to determine dielectric constant distribution of each unit in the dielectric lens such that a non-plane wave in a minor axis direction of the quasi-ellipse is converted into a plane wave through the dielectric lens, further, preparing a plurality of cylindrical units through extrusion, injection, molding, CNC machining, or a 3D printing process technology based on the dielectric constant distribution, and connecting and assembling the plurality of cylindrical units through welding, gluing, or structural clamping, to obtain the cylindrical lens.

It can be learned that, after the dielectric constant distribution is obtained, the dielectric lens may be obtained by assembling the plurality of cylindrical units, or the dielectric lens may be formed using the 3D printing technology. In a preparation method for a unit assembly process of the dielectric lens, a first step is to prepare, through extrusion, injection, molding, CNC machining, or a 3D printing process technology, cylindrical units required by the dielectric lens, and a second step is to connect and assemble, through welding, gluing, or structural clamping, the plurality of cylindrical units that are prepared in the first step, to obtain the dielectric lens.

In this embodiment of this application, the size of the dielectric lens may be designed as required, to implement miniaturization of the lens. The used printed powder or ink may be high-molecular materials or high-molecular polymers having low density to implement lightweight of the lens. In this way, when the dielectric lens is applied to the multi-beam antenna, miniaturization and lightweight of the multi-beam antenna can also be implemented.

Further, an embodiment of this application further provides a multi-beam antenna, and the multi-beam antenna includes the foregoing cylindrical lens. Further, the multi-beam antenna includes a radome, a dielectric lens, a reflection panel, and a dipole array.

The dielectric lens is disposed between the radome and the dipole array, and the dipole array is used as a feed of the dielectric lens. The dipole array is disposed between the dielectric lens and the reflection panel, and a feeding network required by the dipole array is disposed on a back facet of the reflection panel or is integrated into the reflection panel. The dielectric lens has a first size in a thickness direction of the multi-beam antenna, the dielectric lens has a second size in a width direction of the multi-beam antenna, and the first size is less than the second size.

In other words, the multi-beam antenna may also be understood as replacing the cylindrical lens in FIG. 2 with the cylindrical lens in this embodiment, and a minor axis of a quasi-ellipse serving as a cross section of the cylindrical lens is in a thickness direction of the antenna, and a major axis is in a width direction of the antenna.

In specific implementation, a size (for example, the minor axis and the major axis of the quasi-ellipse) of the cylindrical lens may be determined based on a size requirement of the multi-beam antenna (for example, a thickness requirement and a width requirement of the multi-beam antenna), and further dielectric constant distribution of the cylindrical lens is determined through simulation. Therefore, the cylindrical lens is designed as required. It can be learned that the minor axis of the quasi-ellipse may be designed to be far less than the major axis, i.e., a thickness of the cylindrical lens is far less than a width. In this way, when the dielectric lens is applied to the antenna, compared with another existing lens (for example, a Luneberg lens) whose dielectric constant cannot be adjusted or designed, a thickness of the antenna may be greatly reduced while meeting antenna performance. For example, it may be ensured that the thickness is within 300 mm. Correspondingly, after the lens is applied to the antenna, the thickness of the antenna may be reduced to a value less than 350 mm. Corresponding to some more optimized solutions, the thickness may be even within 250 mm.

In this way, the dielectric lens in this embodiment of this application can be applied to the multi-beam antenna, to expand a capacity of a communications system. In addition, using the dielectric lens, dielectric constants of lens materials may be designed as required, and spatial distribution of the dielectric constant is determined based on electromagnetic simulation such that a thickness of the antenna is greatly reduced while meeting antenna performance.

Figure 16:
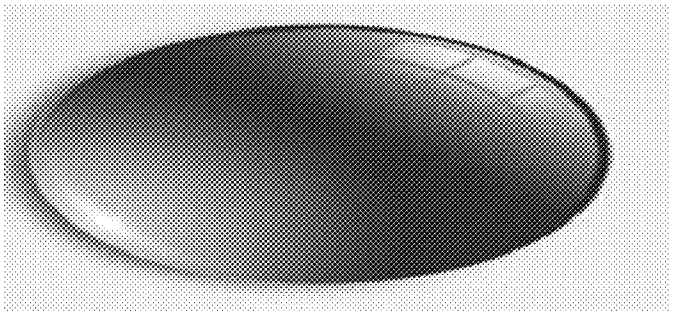
FIG. 16 is a schematic diagram of a dielectric lens according to another embodiment of this application.

FIG. 16 is a schematic diagram of a dielectric lens according to another embodiment of this application. The dielectric lens shown in FIG. 16 is a quasi-ellipsoidal lens, and a maximum cross section of the quasi-ellipsoidal lens is a quasi-ellipse.

A quasi-ellipsoid is an approximate ellipsoid. In addition, it should be understood that the quasi-ellipsoid includes an ellipsoid, i.e., the dielectric lens may be an ellipsoidal lens. The quasi-ellipse is an approximate ellipse. In addition, it should be understood that the quasi-ellipse includes an ellipse, i.e., the maximum cross section of the dielectric lens may be an ellipse.

The quasi-ellipsoid generally has one major axis and two minor axes. The maximum cross section herein is a cross section in which the major axis and a larger minor axis of the quasi-ellipsoid are located.

Figure 17:
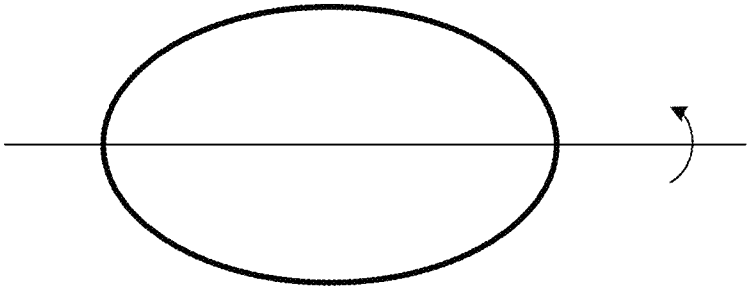
FIG. 17 is a schematic diagram of forming a lens in a shape of an ellipsoid of revolution according to an embodiment of this application.

Optionally, in an embodiment, the dielectric lens may be in a shape of an ellipsoid of revolution. As shown in FIG. 17, it may be geometrically considered that the dielectric lens is formed after an ellipse (namely, an ellipse serving as the maximum cross section) rotates around its major axis for one circle.

The quasi-ellipsoidal lens is formed by tightly piling a plurality of units, dielectric constant distribution of the plurality of units in the dielectric lens enables a non-plane wave in a minor axis direction of the quasi-ellipse to be converted into a plane wave after passing through the lens, and the dielectric constant distribution is obtained through numerical fitting based on Fermat's principle and Snell's law. Each unit is a solid unit or a hollow unit.

The quasi-ellipsoidal lens may be formed by tightly piling the plurality of units in a block stacking manner.

Optionally, a connection between the plurality of units is any one of welding, gluing, structural clamping, and a connection printed using a 3D printing technology.

The welding may be ultrasonic welding or diffusion welding, or may be welding of another form. This is not limited in this application.

In addition, a connection manner between a plurality of units in a same quasi-ellipsoidal lens may be the same or different. For example, a connection manner between some units is welding, and a connection manner between some other units is gluing. For example, a connection manner between some units is ultrasonic welding, and a connection manner between some other units is diffusion welding.

From a perspective of one unit, in an embodiment, the unit is a solid first polyhedron.

Optionally, the unit may be a first polyhedron having a first circumscribed sphere, i.e., the first polyhedron is an inscribed polyhedron of the first sphere. A diameter of the first sphere may be denoted as d1, and 1 mm≤d1≤450 mm. It should be noted that a size of d1 may also be another value. This is not limited herein.

It should be noted that a value of d1 may be any value between 1 mm and 450 mm. For example, d1=1 mm, or d1=30 mm. This is not limited in this application.

The first polyhedron may be a regular polyhedron. If the first polyhedron is the regular polyhedron, and a quantity of faces of the first polyhedron is greater than a preset first threshold, the first polyhedron may be approximated as a sphere. The approximate sphere is a circumscribed sphere of the first polyhedron, namely, a first sphere. The unit may be spherical. For example, if the first polyhedron is a regular dodecahedron or a regular icosahedron, it may be considered that the first polyhedron is a sphere.

Optionally, the first polyhedron may be a polyhedron having a first circumscribed ellipsoid of revolution, i.e., the first polyhedron may be an inscribed polyhedron of the first ellipsoid of revolution. A major axis of the first ellipsoid of revolution is denoted as d1a, a minor axis of the first ellipsoid of revolution is denoted as d1b, and 1 mm≤d1b<d1a≤450 mm.

It should be noted that for d1a and d1b, d1b<d1a, and values of both d1a and d1b may be any value between 1 mm and 450 mm. For example, d1a=20 mm, and d1b=5 mm. This is not limited in this application.

If the first polyhedron is a polyhedron having a first symmetry face and a second symmetry face, and the first symmetry face and the second symmetry face are two symmetry faces of the first ellipsoid of revolution, when a quantity of faces of the first polyhedron is greater than a preset second threshold, the first polyhedron may be approximated as an ellipsoid. The approximate first polyhedron is a circumscribed ellipsoid of revolution of the first polyhedron, namely, the first ellipsoid of revolution. The unit may be in a shape of an ellipsoid of revolution. For example, the second threshold may be equal to 12 or 20.

From a perspective of one unit, in another embodiment, the unit is a solid unit, and the unit is a fourth sphere or a fourth ellipsoid of revolution.

A diameter of the fourth sphere is denoted as d4, and 1 mm≤d4≤450 mm. Alternatively, a major axis of the fourth ellipsoid of revolution is denoted as d4a, a minor axis of the fourth ellipsoid of revolution is denoted as d4b, and 1 mm≤d4b<d4a≤450 mm.

It should be noted that a value of d4 may be any value between 1 mm and 450 mm, for example, d1=1 mm. For d4a and d4b, d4b<d4a, and values of both d4a and d4b may be any value between 1 mm and 450 mm. For example, d4a=10 mm, and d4b=3 mm. This is not limited in this application.

From a perspective of one unit, in another embodiment, the unit is a hollow unit, an outer profile of the unit is a second polyhedron, and an inner profile is a third polyhedron. A quantity of faces of the second polyhedron and a quantity of faces of the third polyhedron may be equal or unequal.

It should be noted that, if the quantity of faces of the second polyhedron and the quantity of faces of the third polyhedron are equal, a face of the second polyhedron may be parallel to a corresponding face of the third polyhedron, or a face of the second polyhedron is not parallel to any face of the third polyhedron. This is not limited in this application.

Optionally, the second polyhedron may be an inscribed polyhedron of a second sphere, and the third polyhedron may be an inscribed polyhedron of a third sphere. A diameter of the second sphere is denoted as d2, a diameter of the third sphere is denoted as d3, and 1 mm≤d3<d2≤450 mm.

It should be noted that for d2 and d3, d3<d2, and values of d2 and d3 may be any value between 1 mm and 450 mm. For example, d2=100 mm, and d3=20 mm. This is not limited in this application.

In an example, the second polyhedron is a regular polyhedron, and/or the third polyhedron is a regular polyhedron.

Optionally, the second polyhedron is a regular polyhedron, the third polyhedron is a regular polyhedron, and a quantity of faces of the second polyhedron and a quantity of faces of the third polyhedron may be equal or unequal. In this case, the second polyhedron and the third polyhedron may have a same symmetry face or different symmetry faces. Optionally, the second polyhedron is a regular polyhedron, the third polyhedron is a non-regular polyhedron, and a quantity of faces of the second polyhedron and a quantity of faces of the third polyhedron may be equal or unequal. Optionally, the second polyhedron is a non-regular polyhedron, the third polyhedron is a regular polyhedron, and a quantity of faces of the second polyhedron and a quantity of faces of the third polyhedron may be equal or unequal. Optionally, the second polyhedron is a non-regular polyhedron, the third polyhedron is a non-regular polyhedron, and a quantity of faces of the second polyhedron and a quantity of faces of the third polyhedron may be equal or unequal.

If the second polyhedron is a regular dodecahedron or a regular icosahedron, the third polyhedron is a regular dodecahedron or a regular icosahedron, and centers of the second polyhedron and the third polyhedron coincide, it may be considered that the unit is a hollow spherical shell.

Optionally, the second polyhedron is an inscribed polyhedron of a second ellipsoid of revolution, and the third polyhedron is an inscribed polyhedron of a third ellipsoid of revolution. A major axis of the second ellipsoid of revolution is denoted as d2a, a minor axis of the second ellipsoid of revolution is denoted as d2b, a major axis of the third ellipsoid of revolution is denoted as d3a, and a minor axis of the third ellipsoid of revolution is denoted as d3b. 1 mm≤d3a<d2a≤450 mm, 1 mm≤d3b<d2b≤450 mm, d2a>D2b, and d3a>d3b.

It should be noted that for d2a, d2b, d3a, and d3b, d3a<d2a, d3b<d2b, d2a>d2b, and d3a>d3b, and values of d2a, d2b, d3a, and d3b may be any value between 1 mm and 450 mm. For example, d2a=180 mm, d2b=120 mm, d3a=90 mm, and d3b=20 mm. This is not limited in this application.

If the second polyhedron has a first symmetry face and a second symmetry face, the third polyhedron has a first symmetry face and a second symmetry face, and the first symmetry face and the second symmetry face are two symmetry faces of the second ellipsoid of revolution, when both a quantity of faces of the second polyhedron and a quantity of faces of the third polyhedron are greater than a preset fourth threshold, the unit may be considered as a hollow ellipsoid of revolution. For example, the fourth threshold may be equal to 12 or 20.

From a perspective of one unit, in another embodiment, the unit is a hollow unit, an outer profile of the unit is a fifth sphere or a fifth ellipsoid of revolution, and an inner profile is a sixth sphere or a sixth ellipsoid of revolution.

A diameter of the fifth sphere is denoted as d5, a diameter of the sixth sphere is denoted as d6, a major axis of the fifth ellipsoid of revolution is denoted as d5a, a minor axis of the fifth ellipsoid of revolution is denoted as d5b, a major axis of the sixth ellipsoid of revolution is denoted as d6a, and a minor axis of the sixth ellipsoid of revolution is denoted as d6b. 1 mm≤d6<d5≤450 mm, 1 mm≤d6a<d5a≤450 mm, 1 mm≤d6b<d5b≤450 mm, d5a>d5b, and d6a>d6b.

Optionally, the outer profile is the fifth sphere, and the inner profile is the sixth sphere. In addition, 1 mm≤d6<d5≤450 mm.

Optionally, the outer profile is the fifth sphere, and the inner profile is the sixth ellipsoid. In addition, 1 mm≤d6b<d6a<d5≤450 mm.

Optionally, the outer profile is the fifth ellipsoid, and the inner profile is the sixth sphere. In addition, 1 mm≤d6<d5b<d5a≤450 mm.

Optionally, the outer profile is the fifth ellipsoid, and the inner profile is the sixth ellipsoid. In addition, 1 mm≤d6a<d5a≤450 mm, 1 mm≤d6b<d5b≤450 mm, d6b<d6a, and d5b<d5a.

It should be noted that, although value ranges of d1, d2, d3, d4, d5, d6, d1b, d1a, d2b, d2a, d3b, d3a, d4b, d4a, d5b, d5a, d6b, and d6a are provided as an example in the foregoing embodiment, the ranges are not limited in this application. In addition, each value may be any value within its range, and no enumeration is provided herein.

It can be understood that in this embodiment of this application, the unit may also be another polyhedron in an irregular shape. For example, the unit may be a polyhedron in an irregular shape that has neither a circumscribed sphere nor a circumscribed ellipsoid. No enumeration is provided herein.

Similar to the foregoing cylindrical lens, the dielectric constant of the unit in the quasi-ellipsoidal lens may be denoted as $\varepsilon_{xyz}(x, y, z)$. The dielectric constant of the unit is related to a location of the unit in the dielectric lens. Further, the dielectric constant of the unit is $\varepsilon_{xyz}(x, y, z)$, which indicates that the dielectric constant $\varepsilon$ is related to coordinates x, y, and z, coordinates x, y, and z may be center-of-mass coordinates of the unit.

In specific implementation, a dielectric constant of each unit is allowed within an error range. For example, assuming that a dielectric constant of a unit A is $\varepsilon_0$, a value of a dielectric constant at any point in the unit may be within an error range around $\varepsilon_0$. For example, if the error range is 10%, the value of the dielectric constant at any point in the unit may be within a range of $\varepsilon_0-\varepsilon_0\times10\%$ to $\varepsilon_0+\varepsilon_0\times10\%$.

Further, an embodiment of this application further provides a dielectric lens manufacturing method. The manufacturing method may include using printed powder or ink having different dielectric constants to obtain a mixture corresponding to each unit in the dielectric lens, where the mixture meets a dielectric constant of a corresponding unit, and dielectric constant distribution of each unit in the dielectric lens is determined through numerical fitting based on Fermat's principle and Snell's law such that a non-plane wave in a minor axis direction of the quasi-ellipse is converted into a plane wave through the dielectric lens, and generating the dielectric lens using the mixture.

Optionally, the method may be performing numerical fitting based on Fermat's principle and Snell's law to determine dielectric constant distribution of each unit in the dielectric lens (the quasi-ellipsoidal lens) such that a non-plane wave in a minor axis direction of the quasi-ellipse is converted into a plane wave through the dielectric lens, further, using printed powder or ink having different dielectric constants to obtain a mixture corresponding to each unit in the dielectric lens, where the mixture meets a dielectric constant of a corresponding unit, and generating the dielectric lens using the mixture.

Further, a size of the dielectric lens may be first determined based on an actual requirement of the multi-beam antenna, and a quantity, a size, a shape, and the like of the unit are determined based on the size of the dielectric lens. Further, numerical fitting may be performed based on Fermat's principle and Snell's law, to determine the dielectric constant distribution. For example, modeling may be performed through COMSOL, to obtain the dielectric constant of each unit. It can be learned that the dielectric constant in the dielectric lens may be designed as required, and spatial distribution of the dielectric constant may be determined through numerical simulation.

It can be understood that if there is a gap between units, for example, the unit is a first sphere or a first ellipsoid of revolution, or an outer profile of the unit is a second sphere or a second ellipsoid of revolution, the gap between the units may be considered as air in a numerical fitting process, and the unit has a dielectric constant of the air. The gap between the units may be considered as a "special unit" having the dielectric constant of the air.

For another example, if the unit is a hollow unit, it may be considered that a hollow area is air, and the unit has a dielectric constant of the air. The hollow area "is filled with" a "special unit" having the dielectric constant of the air.

Optionally, the method may be performing numerical fitting based on Fermat's principle and Snell's law to determine dielectric constant distribution of each unit in the dielectric lens such that a non-plane wave in a minor axis direction of the quasi-ellipse is converted into a plane wave through the dielectric lens, further, preparing a plurality of units through extrusion, injection, molding, CNC machining, or a 3D printing process technology based on the dielectric constant distribution, and connecting and assembling the plurality of units through welding, gluing, or structural clamping to obtain the quasi-ellipsoidal lens.

It can be learned that, after the dielectric constant distribution is obtained, the dielectric lens may be obtained by assembling the plurality of units, or the dielectric lens may be formed using the 3D printing technology.

In a preparation method for a unit assembly process of the dielectric lens, a first step is to prepare, through extrusion, injection, molding, CNC machining, or a 3D printing process technology, units required by the dielectric lens, and a second step is to connect and assemble, through welding, gluing, or structural clamping, the plurality of units that are prepared in the first step to obtain the dielectric lens.

In this embodiment of this application, the size of the dielectric lens may be designed as required to implement miniaturization of the lens. The used printed powder or ink may be high-molecular materials or high-molecular polymers having low density to implement lightweight of the lens. In this way, when the dielectric lens is applied to the multi-beam antenna, miniaturization and lightweight of the multi-beam antenna can also be implemented.

Further, an embodiment of this application further provides a multi-beam antenna, and the multi-beam antenna includes the foregoing ellipsoidal lens. Further, the multi-beam antenna includes a radome, a dielectric lens, a reflection panel, and a dipole array.

The dielectric lens is disposed between the radome and the dipole array, and the dipole array is used as a feed of the dielectric lens. The dipole array is disposed between the dielectric lens and the reflection panel, and a feeding network required by the dipole array is disposed on a back facet of the reflection panel or is integrated into the reflection panel. The dielectric lens has a first size in a thickness direction of the multi-beam antenna, the dielectric lens has a second size in a width direction of the multi-beam antenna, and the first size is less than the second size.

In other words, the multi-beam antenna may also be understood as replacing the spherical lens in FIG. 4 with the quasi-ellipsoidal lens in this embodiment, and a minor axis of a quasi-ellipse serving as a maximum cross section of the quasi-ellipsoidal lens is in a thickness direction of the antenna, and a major axis is in a width direction of the antenna.

In specific implementation, a size (for example, the major axis and the two minor axes of the ellipsoidal lens) of the cylindrical lens may be determined based on a size requirement of the multi-beam antenna (for example, a thickness requirement and a width requirement of the multi-beam antenna), and further dielectric constant distribution of the ellipsoidal lens is determined through simulation. Therefore, the ellipsoidal lens is designed as required. It can be learned that the minor axis of the ellipse may be designed to be far less than the major axis, i.e., a thickness of the ellipsoidal lens is far less than a width. In this way, when the dielectric lens is applied to the antenna, compared with another existing lens (for example, a Luneberg lens) whose dielectric constant cannot be adjusted or designed, a thickness of the antenna may be greatly reduced while meeting antenna performance. For example, it may be ensured that the thickness is within 300 mm. Correspondingly, after the lens is applied to the antenna, the thickness of the antenna may be reduced to a value less than 350 mm. Corresponding to some more optimized solutions, the thickness may be even within 250 mm.

In this way, the dielectric lens in this embodiment of this application can be applied to the multi-beam antenna, to expand a capacity of a communications system. In addition, using the dielectric lens, dielectric constants of lens materials may be designed as required, and spatial distribution of the dielectric constant is determined based on electromagnetic simulation such that a thickness of the antenna is greatly reduced while meeting antenna performance.

In the embodiments of this application, the dielectric lens and a manufacturing method therefor are key technologies for implementing a high-gain UMTS/LTE miniaturized antenna, and a success of the technologies may be extended to a future 5G phase.

The term "and/or" in this specification describes only an association relationship for describing associated objects and represents that three relationships may exist. For example, A and/or B may represent the following three cases, only A exists, both A and B exist, and only B exists. In addition, the character "/" in this specification generally indicates an "or" relationship between the associated objects.

The foregoing descriptions are merely specific implementations of this application, but are not intended to limit the protection scope of this application. Any variation or replacement readily figured out by a person skilled in the art within the technical scope disclosed in this application shall fall within the protection scope of this application. Therefore, the protection scope of this application shall be subject to the protection scope of the claims.

What is claimed is:

1. A dielectric lens, the dielectric lens being a cylindrical lens, a cross-sectional profile of the cylindrical lens being a quasi-ellipse, the cylindrical lens being formed by piling a plurality of cylindrical units, dielectric constant distribution of the cylindrical units in the dielectric lens enabling a non-plane wave in a minor axis direction of the quasi-ellipse to be converted into a plane wave after passing through the dielectric lens, and a length of each cylindrical unit being equal to a length of the cylindrical lens.

2. The dielectric lens of claim 1, wherein a cylindrical unit is a solid unit, and a cross section of the cylindrical unit being a first polygon.

3. The dielectric lens of claim 2, wherein the first polygon is an inscribed polygon of a first circle, a diameter of the first circle being denoted as D1, and one millimeter (mm)≤ D1≤four hundred fifty mm.

4. The dielectric lens of claim 2, wherein the first polygon is a regular polygon.

5. The dielectric lens of claim 2, wherein the first polygon is an inscribed polygon of a first ellipse, a major axis of the first ellipse being denoted as D1a, a minor axis of the first ellipse being denoted as D1b, and one millimeter (mm)≤ D1b<D1a≤four hundred fifty mm.

6. The dielectric lens of claim 1, wherein a cylindrical unit is a hollow unit, an outer profile of a cross section of the cylindrical unit being a second polygon, and an inner profile being a third polygon.

7. The dielectric lens of claim 6, wherein the second polygon is an inscribed polygon of a second circle, the third polygon being an inscribed polygon of a third circle, a diameter of the second circle being denoted as D2, a diameter of the third circle being denoted as D3, and one millimeter (mm)≤D3<D2≤four hundred fifty mm.

8. The dielectric lens of claim 6, wherein the second polygon is a regular polygon, or the third polygon being the regular polygon.

9. The dielectric lens of claim 6, wherein the second polygon is an inscribed polygon of a second ellipse, the third polygon being an inscribed polygon of a third ellipse, a major axis of the second ellipse being denoted as D2a, a minor axis of the second ellipse being denoted as D2b, a major axis of the third ellipse being denoted as D3a, a minor axis of the third ellipse being denoted as D3b, one millimeter (mm)<D3a<D2a≤four hundred fifty mm, one mm≤D3b<D2b<four hundred fifty mm, D2a>D2b, and D3a>D3b.

10. The dielectric lens of claim 1, wherein a cylindrical unit is a solid unit, a cross section of the cylindrical unit being a fourth circle or a fourth ellipse, a diameter of the fourth circle being denoted as D4, a major axis of the fourth ellipse being denoted as D4a, a minor axis of the fourth ellipse being denoted as D4b, one millimeter (mm)≤ D4≤four hundred fifty mm, and one mm≤D4b<D4a≤four hundred fifty mm.

11. The dielectric lens of claim 1, wherein a cylindrical unit is a hollow unit, an outer profile of a cross section of the cylindrical unit being a fifth ellipse, an inner profile being a sixth ellipse, a major axis of the fifth ellipse being denoted as D5a, a minor axis of the fifth ellipse being denoted as D5b, a major axis of the sixth ellipse being denoted as D6a, a minor axis of the sixth ellipse being denoted as D6b, one millimeter (mm)<D6a<D5a≤four hundred fifty mm, one mm≤D6b<D5b<four hundred fifty mm, D5a>D5b, and D6a>D6b.

12. The dielectric lens of claim 1, wherein the length is denoted as L, and one hundred millimeters (mm)≤L≤three thousand five hundred mm.

13. The dielectric lens of claim 1, wherein a major axis of the quasi-ellipse is denoted as Da, a minor axis of the quasi-ellipse being denoted as Db, and one millimeter (mm)≤ Db<Da≤four hundred fifty mm.

14. The dielectric lens of claim 1, wherein a coupling between the cylindrical units is any one of welding, gluing, structural clamping, or a coupling printed using a three dimensional (3D) printing technology.

15. The dielectric lens of claim 1, wherein a process of preparing the cylindrical units is any one of extrusion, injection, molding, computer numerical control (CNC) machining, or a three dimensional (3D) printing process technology.

16. A dielectric lens, the dielectric lens being a quasi-ellipsoidal lens, a maximum cross section of the quasi-ellipsoidal lens being a quasi-ellipse, the quasi-ellipsoidal lens being formed by tightly piling a plurality of units, dielectric constant distribution of the units in the dielectric lens enabling a non-plane wave in a minor axis direction of the quasi-ellipse to be converted into a plane wave after passing through the dielectric lens, and each unit being a solid unit or a hollow unit.

17. The dielectric lens of claim 16, wherein a unit is a solid first polyhedron.

18. The dielectric lens of claim 17, wherein the first polyhedron is an inscribed polyhedron of a first sphere, a diameter of the first sphere being denoted as d1, and one millimeter (mm)≤d1≤four hundred fifty mm.

19. The dielectric lens of claim 17, wherein the first polyhedron is a regular polyhedron.

20. The dielectric lens of claim 17, wherein the first polyhedron is an inscribed polyhedron of a first ellipsoid of revolution, a major axis of the first ellipsoid of revolution being denoted as d1 a, a minor axis of the first ellipsoid of revolution being denoted as d1b, and one millimeter (mm) ≤d1b<d1 a≤four hundred fifty mm.

21. The dielectric lens of claim 16, wherein a unit is a fourth sphere, a diameter of the fourth sphere being denoted as d4, and one millimeter (mm)≤d4≤four hundred fifty mm.

22. The dielectric lens of claim 16, wherein a unit is the hollow unit, an outer profile of the unit being a second polyhedron, and an inner profile being a third polyhedron.

23. The dielectric lens of claim 22, wherein the second polyhedron is an inscribed polyhedron of a second sphere, the third polyhedron being an inscribed polyhedron of a third sphere, a diameter of the second sphere being denoted as d2, a diameter of the third sphere being denoted as d3, and one millimeter (mm)≤d3<d2≤four hundred fifty mm.

24. The dielectric lens of claim 22, wherein the second polyhedron is a regular polyhedron, or the third polyhedron being the regular polyhedron.

25. The dielectric lens of claim 22, wherein the second polyhedron is an inscribed polyhedron of a second ellipsoid of revolution, the third polyhedron being an inscribed polyhedron of a third ellipsoid of revolution, a major axis of the second ellipsoid of revolution being denoted as d2a, a minor axis of the second ellipsoid of revolution being denoted as d2b, a major axis of the third ellipsoid of revolution being denoted as d3a, a minor axis of the third ellipsoid of revolution being denoted as d3b, one millimeter (mm)≤d3a<d2a≤four hundred fifty mm, one mm≤d3b<d2b<four hundred fifty mm, d2a>d2b, and d3a>d3b.

26. The dielectric lens of claim 16, wherein a unit is a fourth ellipsoid of revolution, a major axis of the fourth ellipsoid of revolution being denoted as d4a, a minor axis of the fourth ellipsoid of revolution being denoted as d4b, and one millimeter (mm)≤d4b<d4a≤four hundred fifty mm.

27. The dielectric lens of claim 16, wherein a unit is the hollow unit, an outer profile of the unit being a fifth ellipsoid of revolution, an inner profile being a sixth ellipsoid of revolution, a major axis of the fifth ellipsoid of revolution being denoted as d5a, a minor axis of the fifth ellipsoid of revolution being denoted as d5b, a major axis of the sixth ellipsoid of revolution being denoted as d6a, a minor axis of the sixth ellipsoid of revolution being denoted as d6b, one millimeter (mm)≤d6a<d5a≤four hundred fifty mm, one mm≤d6b<d5b≤four hundred fifty mm, d5a>d5b, and d6a>d6b.

28. The dielectric lens of claim 16, wherein a coupling between the units is any one of welding, gluing, structural clamping, or a coupling printed using a three dimensional (3D) printing technology.

29. The dielectric lens of claim 16, wherein a process of preparing the units is any one of extrusion, injection, molding, computer numerical control (CNC) machining, or a three dimensional (3D) printing process technology.

* * * * *